United States Patent [19]

Quast et al.

[11] Patent Number: 4,908,241

[45] Date of Patent: Mar. 13, 1990

[54] PROCESS FOR THE CURRENTLESS DEPOSITION OF ELECTROPOSITIVE METAL LAYERS ON THE SURFACES OF LESS ELECTROPOSITIVE METALS

[75] Inventors: Helmut Quast, Würzburg, Fed. Rep. of Germany; Johannes Raber; Walter Ott, both of Graz, Austria; Hans-Georg von Schnering, Aidlingen; Karl Peters, Leonberg, both of Fed. Rep. of Germany

[73] Assignee: Max-Planck-Gesellschaft zur Foederung der Wissenschaften e.V., Goettingen, Fed. Rep. of Germany

[21] Appl. No.: 222,386

[22] Filed: Jul. 21, 1988

Related U.S. Application Data

[63] Continuation of Ser. No. 446,075, Dec. 1, 1982, abandoned.

[30] Foreign Application Priority Data

Dec. 7, 1981 [DE] Fed. Rep. of Germany ..... 3148330

[51] Int. Cl.[4] ..... B05D 1/18

[52] U.S. Cl. ..... 427/437; 427/436; 427/443.1

[58] Field of Search ..... 427/437, 436, 443.1

[56] References Cited

U.S. PATENT DOCUMENTS 2,836,515 5/1958 McNally ..... 117/130
3,250,784 5/1966 Gensheimer ..... 430/551
3,294,528 12/1966 Popick ..... 427/437
4,650,691 3/1987 Kinoshita ..... 427/437

FOREIGN PATENT DOCUMENTS 1027652 4/1966 United Kingdom ..... 427/437

*Primary Examiner*—Shrive P. Beck
*Assistant Examiner*—Vi D. Dang
*Attorney, Agent, or Firm*—Felfe & Lynch

[57] ABSTRACT

The present invention provides a process for the currentless deposition of electropositive metal layers on to appropriate less electropositive metals by contacting an object to be coated with a coating bath, wherein a coating bath is used which contains a metal complex obtained by reacting a monovalent electropositive metal halide with a base, which is capable of complex formation with the electropositive metal, and a hydrohalic acid.

The present invention also provides a coating bath for the currentless deposition of electropositive metal layers on to less electropositive metals, wherein said bath contains an electropositive metal complex obtained by reacting a monovalent electropositive metal halide with a base which is capable of complex formation with the electropositive metal and a hydrohalic acid.

Furthermore, the present invention provides an electropositive metal complex, obtainable by the reaction of a monovalent electropositive metal halide with a base which is capable of complex formation with the electropositive metal and a hydrohalic acid, followed by precipitation from the reaction mixture.

15 Claims, No Drawings

PROCESS FOR THE CURRENTLESS DEPOSITION OF ELECTROPOSITIVE METAL LAYERS ON THE SURFACES OF LESS ELECTROPOSITIVE METALS

This is a continuation of application Ser. No. 446,075 filed on Dec. 1, 1982, now abandoned.

The present invention is concerned with a process for the currentless deposition of electropositive metal layers on the surfaces of less electropositive metals.

Metallic objects coated with layers of more electropositive metals play an increasingly important part in numerous technical fields, for example in electrotechnology, in electronics, in the construction of medical apparatus, in restoration technology, in corrosion protection, in the jewellery industry, in finishing technology, in space travel, in mechanics and also in teaching.

The known processes for the currentless deposition of electropositive metal layers on the surfaces of less electropositive metals suffer from numerous disadvantages which, in some cases, considerably limit their use. Working with known commercially available coating baths requires relatively long periods of residence of the workpieces in the coating baths and coatings are obtained, the layer thicknesses of which do not, in some cases, satisfy the demanded requirements. A further great disadvantage of the known coating baths is their toxicity due to their cyanide content, which results in special problems in handling and in the disposal of waste.

Therefore, it is an object of the present invention to provide a process for the currentless deposition of electropositive metal layers which avoids the above-mentioned disadvantages and which permits the production of satisfactorily adhering layers of sufficient thickness.

Thus, according to the present invention, there is provided a process for the currentless deposition of electropositive metal layers on to appropriate less electropositive metals by contacting an object to be coated with a coating bath, wherein a coating bath is used which contains a metal complex obtained by reacting a monovalent electropositive metal halide with a base, which is capable of complex formation with the electropositive metal, and a hydrohalic acid.

Monovalent electropositive metal halides which can be used for the preparation of the coating bath are preferably electropositive metal bromides, iodides and chlorides.

Monovalent electropositive metal halides are those of copper and, more preferably, of silver and gold.

As bases capable of complex formation with the metal to be deposited, in principle all compounds can be used which can be protonised by the hydrohalic acid used for the preparation of the coating bath. Having regard to the stability of the complexes and the quality of the coating, those bases are preferably used which are easily protonised under the reaction conditions employed.

In general, especially preferred for the complex formation are basic, nitrogen-containing compounds, especially ammonia and amines, for example ammonium chloride, ammonium bromide, hydroxylamine hydrochloride, hydrazine dihydrochloride, methylammonium chloride, benzylammonium chloride, benzylammonium bromide, 2-aminopropane hydrochloride, cyclohexylammonium chloride, 1-amino-4-methylbicyclo[2.2.2]octane hydrochloride, 1-aminoadamantane hydrochloride, methyl glycine hydrochloride and ethyl glycine hydrochloride; carboxylic acid amides, for example formamide, N-methylformamide, N-isopropylformamide, N-cyclohexylformamide, N-(2,4-dimethylpentyl-3-formamide, N,N-dimethylformamide, N,N-diethylformamide, N-methylacetamide, N-ethylacetamide, N,N-diethylacetamide, and propionamide urea derivatives, for example N,N'-dimethylurea and N,N-dimethylurea; basic nitrogen heterocycles, for example morpholine, N-methylmorpholine, N-methyl-2-pyrrolidinone, N-formylpyrrolidine, 1-azabicyclo[2.2.2]octane hydrochloride, pyridine and quinoline; and basic phosphorus compounds, for example hexamethylphosphoric acid triamide.

In certain cases, it is also possible to add hydrocarbons and halogenated hydrocarbons, for example benzene, 1,2-dichlorobenzene, 1,2,3-trichlorobenzene, chlorobenzene or cyclohexane; or alcohols, for example methanol, ethanol, propanol, propan-2-ol, 2-methylpropanol, butan-1-ol, butan-2-ol, diethyleneglycol, triethylene glycol, glycerol, cyclohexanol, ethylene glycol monoethyl ether, diethylene glycol monomethyl ether or triethylene glycol dimethyl ether; or ethers, for example diisoamyl ether, diethylene glycol diethyl ether, triethylene glycol fimethyl ether, tetraethylene glycol dimethyl ether or dioxan; or ketones, for example acetone, acetylacetone, methyl isopropyl ketone, diisopropyl ketone or cyclohexanone: carboxylic acid esters, for example methyl acetate, ethyl propionate, ethyl acetate or dimethyl phthalate; or carboxylic acid nitriles, for example benzonitrile, benzyl cyanide, propionitrile, isobutyronitrile or acetonitrile; or also sulphur compounds, for example dimethyl sulphoxide, sulfolane, thiosemicarbazide, thiobenzamide or N-phenylthiourea. These compounds give good electropositive metal coating solutions, especially with an excess of concentrated hydriodic acid and electropositive metal halide.

As hydrohalic acid, there are especially preferred hydrochloric acid, hydriodic acid and hydrobromic acid, their suitability generally increasing with the increasing atomic weight of the halogen. The choice of the most suitable acid also depends upon the other components, especially upon the $pK_b$ value of the base or upon the $pK_s$ value of its conjugated acid but also upon the other reaction conditions.

As substrate for the electropositive metals to be deposited, there can generally be used all metals which are less electropositive than the metal to be deposited. Having regard to the properties of the coatings (adhesion and thickness of the layer), especially preferred substrate metals for copper are, for example, zinc, iron and lead; for silver, for example zinc, iron, nickel, tin, lead and copper; and for gold, for example, nickel, copper and silver.

The reaction of the electropositive metal halide with the base and the hydrohalic acid can take place simply by mixing these components together. The reaction can be carried out with or without the presence of a solvent and, when a solvent is used, this can be an excess of the base.

The mole ratio of base/electropositive metal halide/hydrohalic acid is so chosen that the total amount of electropositive metal halide is dissolved by the reaction. This is preferably in the range of from 1 to 40/1/1 although the mole value of the base and of the hydrohalic acid can also be substantially higher, for example twice as high. The most favourable mole ratio depends especially upon the nature of the carrying out of the reaction.

Appropriate solvents are inert towards the complex-forming reaction and are especially aprotic organic solvents, for example carbon tetrachloride and especially acetone. The solvent used must be less basic than the base used. Having regard to these prerequisities, a base, for example dimethylformamide, can also be used as solvent.

The reaction is carried out at ambient temperature or with heating. In the latter case, however, especially in the case of bases which are sensitive to hydrolysis, basic fission products result which, in turn, give hydrohalides with the hydrohalic acid and complex with the electropositive metal halide. This case occurs, for example, when formamide is reacted at an elevated temperature with a hydrohalic acid and an electropositive metal halide. Fission takes place to give formic acid and amine and the latter then reacts at once to give the hydrohalide, which latter is the actual complexing agent. It can also be advantageous to carry out the reaction and the subsequent metal deposition under an inert gas atmosphere, for example under nitrogen.

The electropositive metal halide is preferably introduced in finely pulverised form. The hydrohalic acid be introduced in liquid form or can be passed in in gaseous form.

The reaction preferably takes place according to one of the three following process variants:

(a) Addition of the metal salt and acid to the base, preferably with stirring. The mole ratio base/metal salt/acid is thereby $>30/1/1$. If the base is solid at ambient temperature, it is preferable to operate in the presence of a solvent, for example acetone. The metal salt is then introduced in finely pulverised form. Subsequently, the hydrohalic acid is added dropwise thereto at ambient temperature, the metal salt thereby going into solution and a colourless to yellowish solution being formed. When the metal salt does not go completely into solution, it is possible subsequently to acidify the reaction mixture.

(b) Addition of the metal salt to a mixture of base and acid, while stirring. The appropriate mole ratio is as in (a).

(c) One mole of hydrohalide of the base is dissolved or suspended in an aprotic solvent which is less basic than the base used. One mole of metal salt is added thereto, while stirring, either a clear solution being obtained or the metal complex precipitates out.

The reaction solution obtained, for example, according to one of process variants (a), (b) or (c), possibly after dilution with an appropriate solvent, can be used directly as a coating bath (metal deposition solution).

However, it can be advisable to mix the solutions obtained, after dilution with about 1/5th of the volume of an appropriate solvent (as solvent, there can be used an aprotic solvent which is usable for the reaction, for example acetone or carbon tetrachloride or a mixture thereof), with about a threefold amount of the hydrohalic acid required for the reaction. It is thereby possible to achieve a high stability of the solution, a more rapid deposition, thicker and more uniform layer thicknesses and a better utilisation of the metal salt employed.

The stability of the solutions obtained is generally very good. Solutions of silver complexes can, for example, be stored almost without change for several years.

For a space-saving storage and for transport, it can, however, also be preferable to isolate the electropositive metal complexes from their reaction solutions and only to dissolve them again shortly before use. The electropositive metal complexes can be isolated by diluting the reaction solutions with solvents which only sparingly dissolve the complexes, for example with acetone. From these complexes, the coating bath can then, as required, be obtained by dissolving in an appropriate solvent, for example in dimethylformamide. Dissolving is usually carried out with gentle warming, for example at 60°C. In order to avoid a decomposition of the complex and for maintaining the quality of deposition and stability, overheating should be avoided.

The choice and the amount of the complex-forming components (base, metal and hydrohalic acid) depend especially on the nature of the other complex-forming components, upon the nature of the metal to be deposited but also upon the nature of the metal substrate upon which deposition is to be carried out, as well as upon the reaction conditions employed, for example the nature of the solvent. It is also possible to use two or more bases and/or two or more hydrohalic acids. Furthermore, gold/silver mixtures can also be deposited.

Furthermore, the choice, combination and amount ratio of the complex-forming components also depends upon the desired rate of deposition (reactivity) and selectivity of the coating bath. Thus, we have found that, as a rule, a decreasing acid strength, a decreasing ion diameter of the halide ions in the metal salt and a decreasing strength of the base give a greater reactivity ("strong deposition solution"). On the other hand, such very reactive "strong deposition solutions" (for example very weakly basic amine/metal chloride/hydrochloric acid) on very low electropositive metals (for example on zinc or tin) give more poorly adhering coatings than less reactive "weak deposition solutions" (for example very basic amine/metal iodide/hydriodic acid), with which a very good adhesion of the coating is to be achieved. The gold coating of a zinc foil with a solution of pyridine/gold (I) iodide/hydrochloric acid adheres, for example, better than when coating with a solution of N,N-dimethylformamide/gold(I) iodide/hydrochloric acid.

The deposition of the electropositive metal layers on to the substrate take place according to the methods conventionally used for the currentless deposition from coating baths, especially by dipping the objects to be coated into the deposition bath. In general, the objects to be coated can have any desired shape which is especially determined by the subsequently intended use.

For a satisfactory, readily adhering coating, it is necessary to clean the surface of the metal to be coated, freedom from dust, grease, moisture and especially oxide being particularly observed. After cleaning has taken place, the workpiece to be coated is, in a dry state, then preferably dipped into the coating bath. For a good and uniform coating, it is necessary to leave the object free of movement in the unmoved coating bath.

Instead of dipping the workpiece into the coating bath, contacting can also take place by application (coating on, painting on) of the coating solution (coating bath) on to the workpiece. In the case of this method of coating, it is preferable to use coating baths which are as concentrated as possible. This procedure can be repeated as often as necessary until the desired layer thickness has been achieved. This process is especially preferred when only a part of the object is to be coated (for this purpose, in the case of the dipping in method, a partial covering is necessary by means of a coating which is subsequently easy to remove) or when a dipping in is not possible or only with difficulty, for example in the case of restoration techniques.

The period of the contact time depends especially upon the rate of deposition and upon the desired layer thickness. The deposition procedure can be interrupted at any time (for example by removing the workpiece from the solution) and, after assessment of the coating, can, if necessary, be continued by further contacting. This procedure can be repeated as often as desired until the desired layer thickness is achieved. After the achievement of the desired layer thickness, the residues of the coating bath can be removed with an appropriate solvent, for example methanol, ethanol or acetone, and the workpiece then dried, for example by wiping with a cloth.

The quality of the coating, especially its degree of adhesion, depends, to a large extent, upon the rate of deposition. Too rapid a deposition (too high a reactivity) gives, as a rule, a more poorly adhering "amorphous" coating than with a coating bath of lower reactivity. Favourable coating times are from one minute to one hour.

The rate of deposition (reactivity) of the coating bath can be adjusted by appropriate choice and combination of the complex-forming components. However, it is also dependent upon the concentration of the electropositive metal complex in the coating bath and/or upon the acid concentration. As a rule, the rate of deposition increases with increasing concentration of the electropositive metal complex and acid. The deposition can take place, for example, in only a few seconds from very concentrated solutions.

By variation of the complex-forming components, especially of the base and hydrohalic acid, it is also possible to obtain coating solutions with which only certain metals are selectively coated. The selectivity is also closely connected with the reactivity. Thus, for example, the rate of deposition for a particular metal can be regulated by variation of the amount of acid. A change of the concentration of the electropositive metal complexes usually only influences the rate of deposition.

The achievable layer thicknesses are usually proportional to the electropositive metal complex concentration of the coating bath and to the contact time. By appropriate choice of the deposition conditions, there are generally obtained layer thicknesses of 0.01 to 4 $\mu$m.

It is also possible to combine the process according to the present invention of currentless metal deposition with a galvanic deposition process, with the use of current, the two deposition processes thereby taking place simultaneously or successively. In this manner, even thicker layer thicknesses can, as a rule, be achieved.

It is preferable always to use a coating bath only for substrates of the same metal. The deposition (layer thickness) can be monitored by potential measurement. Thus, for example, by potential measurement on a copper plate, the end value of the coating (maximum coating) is indicated after 4 days. In order to measure the potential as free as possible from retroaction, an electrometer amplifier is used therefor for (input current $<50$ mA) and a silver wire is used as reference potential. The initial potential amounted to 100 mV and, after the above-mentioned time, reached practically a zero value. The change of potential during the deposition process was recorded graphically with the help of a recorder.

By means of a dropwise addition of concentrated acid, there can be achieved an almost quantitative utilisation of the complexed metal for the deposition from the coating baths which appear to be "exhausted". Too large an amount of acid is thereby recognised by an immediate precipitation of the metal still present in solution as halide or, in the case of gold, as metal.

From the exhausted solutions, the metal can be precipitated out as halide by dilution with water or, in the case of gold, as metal by the addition of an aqueous ferrous salt solution and then passed on to a recycling process. In this manner, it is possible to keep the contamination of the environment low when using the process according to the present invention.

Thus, with the process according to the present invention, a process is provided with which, in a very simple and rapid manner, it is possible to obtain readily adhering and corrosion-resistant coatings (for example bloom golding) with layer thicknesses which have hitherto not been achieved with currentless processes. The process can be carried out without great mechanical expense and at ambient temperature and thus without a large expense for energy. By means of working at ambient temperature, it is, in addition, also possible to coat objects which cannot be coated by galvanic deposition or by currentless coating with conventional baths because of their temperature sensitivity. By means of simple recycling (precipitation of the metals from the "exhausted" coating baths, distillation of the solvents), the contamination of the environment is very low. Due to the use of the cyanide-free coating baths, the problems of handling and waste disposal which arise in the case of the known cyanide-containing coating baths are, in particular, avoided. Due to the use of non-poisonous and low volatility materials, a danger-free contacting of the objects to be coated is possible by means of simple application (painting).

Finally, because of the indicated large possibilities of variation in the production of the coating baths, it is possible to obtain coating baths of differing reactivity and selectivity, the rate of deposition, the layer thickness, the selectivity for various metallic substrates and the like thereby being capable of regulation. In this manner, there is also, for example, provided the possibility of specifically coating workpieces which are composed of different metals and which are not to be or cannot be dismounted.

The present invention also provides a coating bath for the currentless deposition of electropositive metal layers on to appropriate less electropositive metals, wherein it contains a metal complex obtained by the reaction of a monovalent electropositive metal halide with a base, which is capable of complex formation with the electropositive metal, and a hydrohalic acid.

Furthermore, the present invention provides electropositive metal complexes obtained by the reaction of a monovalent electropositive metal halide with a base which is capable of complex formation with the electropositive metal and a hydrohalic acid.

Mass spectroscopic and X-ray structural analytical investigations give, for complexes from N,N-dimethylformamide or N,N-diethylacetamide as base, silver iodide and hydriodic acid, the structure H[N,N-dimethylformamide]$Ag_2I_3$ and H[N,N-diethylacetamide]$Ag_5I_6$. Therefore, the metal complexes according to the present invention are assumed to have the general formula:

$H[base]Me_nX_{n+1}$ wherein n is a whole number and X is a halogen atom. The chain length of the anion is thereby presumably determined by the nature of the base.

In the following Table, there are given the melting points (in °C., with decomposition) of some electropositive metal complexes according to the present invention which were obtained in crystallised form by dilution of the reaction mixture with acetone:

TABLE

| complex-forming components | melting point (°C.) |
|---|---|
| AgI/HI/DMF | 223–225 |
| AgI/HBr/DMF | 215–216 |
| AgI/HCl/DMF | 119–121 |
| AgBr/HI/DMF | 220–222 |
| AgI/HI/MMF | 144–146 |
| AgI/HBr/MMF | 103–105 |
| AgBr/HI/MMF | 105–107 |
| AgI/HI/N—methyl-2-pyrrolidinone | 186–188 |
| AgI/HI/N,N—diethylacetamide | 146–148 |
| AgI/HI/tetramethylurea | 154–156 |

DMF = N,N—dimethylformamide;
MMF = N—methylformamide

The following Examples are given for the purpose of illustrating the present invention:

EXAMPLE 1.

(a) Production of a copper coating bath.

20 ml. N,N-dimethylformamide are mixed with 1 ml. concentrated hydrochloric acid (12N, specific weight 1.19) and 0.98 g. finely-pulverised cuprous chloride are introduced, while stirring, into this solution at ambient temperature. After complete dissolving, the mixture is diluted with 10 ml. acetone.

(b) Coating.

Into the solution produced in (a), there is dipped a dry iron object to be coppered, which has been freed from oxide and other impurities, at ambient temperature for a period of 2 minutes, whereafter it is removed from the solution and polished with a cloth. The layer thickness of the copper coating is 0.2 μm. In order to obtain greater layer thicknesses, the iron object can be dipped in, removed and polished as often and as long as desired (up to several hours). In this manner, it is possible continuously to monitor the growth of the resulting coating.

EXAMPLE 2.

(a) Production of a silver coating bath.

20 ml. N,N-dimethylformamide are mixed with 0.4 ml. concentrated hydrochloric acid (12N, specific weight 1.19) and, while stirring, 0.94 g. of finely pulverised silver iodide is introduced at ambient temperature into this solution. After dissolving is complete, it is diluted with 5 ml. acetone.

(b) Coating.

Into the solution produced in (a), there is dipped at ambient temperature a dry copper object to be silvered, which has been freed from oxide and other impurities, for 10 minutes, whereafter it is removed from the solution and polished with a cloth. The thickness of the silver coating amounts to about 1 μm. In order to achieve greater layer thicknesses, it is possible to proceed in the manner described in Example 1 (b).

EXAMPLE 3.

(a) Production of a cold coating bath.

30 ml. N,N-dimethylformamide are mixed with 0.3 ml. concentrated hydrochloric acid (12N, specific weight 1.19) and, while stirring at ambient temperature, 0.3 g. gold (I) iodide in finely pulverised form is introduced into this solution. After dissolving is complete, it is diluted with 10 ml. acetone.

(b) Coating.

Into the solution produced in (a), there is dipped at ambient temperature a dry copper or silver object to be gilded, which has been freed from oxide and other impurities, for 1 hour, whereafter it is removed from the solution and polished with a cloth. The thickness of the gold layer is about 0.5 μm. The coating can be interrupted at any time during this hour in order to monitor and observe (and possibly measure) the coating procedure. For further coating, there can be used the procedure described in Example 1 (b).

The coating baths can be used until they are exhausted. It is thereby to be observed that the rate of coating is directly proportional to the concentration of the metal complex still present in the solution.

After completion of the coating procedure, the coated object can be rinsed with, for example, acetone, ethanol, methanol, wash benzine or water, in order to remove traces of the coating bath.

We claim:

1. Process for the currentless deposition of silver or gold on to appropriate less electropositive metals by contacting an object to be coated with a coating bath which contains a metal complex obtained by reacting silver or gold chloride with a base which is capable of complex formation with silver or gold, and hydrochloric acid, the mole ratio of base/silver or gold chloride/-hydrochloric acid being (1 to 80)/1/(1 to 2), said object being contacted with said coating bath/or a time sufficient to produce a layer of silver or gold having a thickness of from 0.01 to 4 μm.

2. Process according to claim 1, wherein the base capable of complex formation is one which can be protonised by the hydrochloric acid.

3. Process according to claim 1, wherein the base capable of complex formation is a basic nitrogen compound.

4. Process according to claim 1, wherein the mole ratio of base silver or gold chloride/hydrochloric acid is 1 to 40/1/1.

5. Process according to claim 1, wherein the metal complex is produced by the reaction of the base, silver or gold chloride and hydrochloric acid in an aprotic organic solvent.

6. Process according to claim 1, wherein the metal complex is produced by the reaction of the base, silver or gold chloride and hydrochloric acid at ambient temperature.

7. Process according to claim 1, wherein to a reaction solution obtained by the reaction of the base, silver or gold chloride and hydrochloric acid, there is added about a three-fold amount of hydrochloric acid used for the reaction and the solution thus obtained is used as the coating bath.

8. Process according to claim 1, wherein to a reaction solution obtained by the reaction of the base, silver or gold chloride and hydrochloric acid, there is added about three-fold the amount of hydrochloric acid used for the reaction and the solution thus obtained is used as the coating bath.

9. Process according to claim 1, wherein the silver or gold complex is precipitated from a reaction solution obtained by the reaction of the base, silver or gold chloride and hydrochloric acid, the precipitated electropositive metal complex is dissolved in an appropriate solvent and the solution thus obtained in used as the coating bath.

10. Process according to claim 1, wherein the contacting of the object to be coated with the coating bath comprises dipping or immersing the object into the coating bath.

11. Process according to claim 1, wherein the contacting of the object to be coated, with the coating bath, comprises applying the coating bath to the object to be coated.

12. Process according to, claim 2 wherein the deposition is carried out at ambient temperature.

13. Process according to claim 1, wherein it is combined with a galvanic deposition process.

14. Process according to claim 1, wherein silver is deposited on to zinc, iron, nickel, tin, lead or copper.

15. Process according to claim 1, wherein gold is deposited on to tin, zinc, lead, iron, platinum, nickel, copper, silver or an alloy thereof.

* * * * *

UNITED STATES PATENT AND TRADEMARK OFFICE

CERTIFICATE OF CORRECTION

PATENT NO. : 4,908,241

DATED : March 13, 1990

INVENTOR(S) : Helmut Quast, et al

It is certified that error appears in the above-identified patent and that said Letters Patent is hereby corrected as shown below:

Column 2, line 5, change "pentyl-3-formamide" to --pentyl-3)-formamide--.

Column 10, line 7, change "claim 2" to --claim 1-- Old claim 14 is dependent on claim 1, therefore new claim 12 should be dependent on claim 1.

Signed and Sealed this

Fourteenth Day of January, 1992

*Attest:*

HARRY F. MANBECK, JR.

*Attesting Officer*

*Commissioner of Patents and Trademarks*